US008070441B1

(12) United States Patent
Liang

(10) Patent No.: US 8,070,441 B1
(45) Date of Patent: Dec. 6, 2011

(54) TURBINE AIRFOIL WITH TRAILING EDGE COOLING CHANNELS

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 1143 days.

(21) Appl. No.: 11/880,292

(22) Filed: Jul. 20, 2007

(51) Int. Cl.
*F01D 5/18* (2006.01)

(52) U.S. Cl. ..... 416/97 R

(58) Field of Classification Search ..... 416/97 R; 415/115
See application file for complete search history.

(56) References Cited

U.S. PATENT DOCUMENTS

| | | | | |
|---|---|---|---|---|
| 3,934,322 | A | 1/1976 | Hauser et al. | |
| 4,407,632 | A | 10/1983 | Liang | |
| 4,752,186 | A | 6/1988 | Liang | |
| 4,767,268 | A | 8/1988 | Auxier et al. | |
| 5,288,207 | A | 2/1994 | Linask | |
| 5,370,499 | A | 12/1994 | Lee | |
| 5,669,759 | A | 9/1997 | Beabout | |
| 5,752,801 | A | 5/1998 | Kennedy | |
| 6,481,966 | B2 | 11/2002 | Beeck et al. | |
| 6,508,620 | B2 | 1/2003 | Sreekanth et al. | |
| 6,599,092 | B1 | 7/2003 | Manning et al. | |
| 6,607,355 | B2 | 8/2003 | Cunha et al. | |
| 6,929,451 | B2 | 8/2005 | Gregg et al. | |
| 7,156,619 | B2 * | 1/2007 | Papple | 416/96 R |
| 7,156,620 | B2 * | 1/2007 | Papple | 416/96 R |
| 7,189,060 | B2 * | 3/2007 | Liang | 416/97 R |
| 2003/0223862 | A1 * | 12/2003 | DeMarche et al. | 415/115 |
| 2005/0111977 | A1 * | 5/2005 | Lee et al. | 416/97 R |
| 2005/0191167 | A1 * | 9/2005 | Mongillo et al. | 415/115 |
| 2005/0244264 | A1 * | 11/2005 | Jacks et al. | 415/115 |
| 2005/0265842 | A1 * | 12/2005 | Mongillo et al. | 416/97 R |
| 2006/0140762 | A1 * | 6/2006 | Pietraszkiewicz et al. | 416/97 R |
| 2006/0153679 | A1 * | 7/2006 | Liang | 416/97 R |
| 2006/0239819 | A1 * | 10/2006 | Albert et al. | 416/97 R |
| 2007/0031252 | A1 * | 2/2007 | Walters et al. | 416/97 R |
| 2007/0071601 | A1 * | 3/2007 | Papple | 416/97 R |

* cited by examiner

*Primary Examiner* — Justine Yu
*Assistant Examiner* — Aaron R Eastman
(74) *Attorney, Agent, or Firm* — John Ryznic

(57) ABSTRACT

A turbine airfoil such as a turbine stator vane used in an industrial gas turbine engine, the vane including a trailing edge region having a thin wall cooling channel arrangement of mini cooling channels formed by a series of rows of elongated flow blockers that form the mini cooling channels between adjacent flow blockers. The adjacent row of flow blockers are offset from the each other such that the inlet and the outlet flow of cooling air is discharged directly onto the flow blocker in order to produce impingement cooling. The mini cooling channels have a spacing to hydraulic diameter ratio of less than 4.0 and a mini channel length to hydraulic diameter ratio of 5.0 of less in order to maintain a high flow velocity within the mini channels. In one embodiment, the flow blockers have a progressively decreasing length in the flow direction of the cooling air.

9 Claims, 3 Drawing Sheets

View A-A

View A-A

TURBINE AIRFOIL WITH TRAILING EDGE COOLING CHANNELS

BACKGROUND OF THE INVENTION

1. Field of the Invention

The present invention relates generally to fluid reaction surfaces, and more specifically to a turbine airfoil with trailing edge cooling channels.

2. Description of the Related Art including information disclosed under 37 CFR 1.97 and 1.98

A gas turbine engine, especially an industrial gas turbine engine, includes a turbine section with multiple stages of turbine blades and stator guide vanes to convert the energy from a hot gas flow into mechanical energy to drive the rotor shaft. The efficiency of the engine can be increased by passing a higher gas flow temperature into the turbine. However, the highest temperature that the turbine can be exposed to is related to the material characteristics of the vanes and blades in the first stage. The higher the inlet temperature to the turbine, the higher will be the engine efficiency.

In order to allow for higher gas flow temperatures into the turbine, the turbine airfoils include complex internal cooling circuits to provide cooling for the airfoils. The engine efficiency is also increased by passing less cooling air through the airfoils for cooling. Since the cooling air used in the turbine airfoils is typically pressurized cooling air from the compressor of the engine, using less bleed off air from the compressor will also increase the engine efficiency.

A turbine rotor blade must be designed to not only have adequate cooling, but also be capable of withstanding the high centrifugal forces that develop on the blade from the rotation during operation. Also, the turbine rotor blades are subject to high temperatures that lower the material strength of the blades and can lead to creep problems from long exposure to strain. Erosion is also a problem in turbine airfoils if hot spots develop on portions of the airfoil that is not adequately cooled. Thus, it is desirable to provide for a turbine airfoil such as a turbine rotor blade with a minimum amount of material to reduce weight, and to provide for a maximum amount of cooling using a minimum amount of cooling air.

It is known in the art of turbine airfoil cooling that cooling efficiency can be improved by a reduction of the cooling channel wall thickness. However, for a low cooling flow design, as the airfoil wall thickness is reduced the internal cooling channel cross sectional flow area will increase. This will reduce the internal flow Mach number and through flow velocity, and thus reduce the cooling flow channel internal heat transfer coefficient as well as the channel convective performance.

U.S. Pat. No. 7,189,060 issued to Liang (the same inventor of the present application) on Mar. 13, 2007 and entitled COOLING SYSTEM INCLUDING MINI CHANNELS WITHIN A TURBINE BLADE OF A TURBINE ENGINE discloses a turbine blade with mini channels formed within the cooling channels along the blade spanwise direction of the serpentine flow cooling circuit. The channels are formed by ribs that have the same length throughout the channel from near the platform to near the tip. The mini channels of the present invention are formed in the trailing edge region of the blade in which the width of the blade decreases. The mini channels in the trailing edge of the blade of the present invention have different structure than the mini channels in the earlier Liang patent.

It is therefore an object of the present invention to provide for a turbine airfoil with a thin wall convection cooling channel along the trailing edge of the airfoil in order to improve the cooling of the trailing edge region.

It is another object of the present invention to provide for a turbine airfoil with a trailing edge cooling channel that will increase the cooling effectiveness without increasing the internal cooling channel air flow area so that the cooling effectiveness is increased.

BRIEF SUMMARY OF THE INVENTION

A turbine airfoil such as a turbine stator vane used in an industrial gas turbine engine, the vane including a trailing edge region having a thin wall cooling channel arrangement of mini cooling channels formed by a series of rows of elongated flow blockers that form the mini cooling channels between adjacent flow blockers. The adjacent row of flow blockers are offset from the each other such that the inlet and the outlet flow of cooling air is discharged directly onto the flow blocker in order to produce impingement cooling. The mini cooling channels have a spacing to hydraulic diameter ratio of less than 4.0 and a mini channel length to hydraulic diameter ratio of 5.0 of less in order to maintain a high flow velocity within the mini channels. In one embodiment, the flow blockers have a progressively decreasing length in the flow direction of the cooling air.

DETAILED DESCRIPTION OF THE INVENTION

Figure 1:
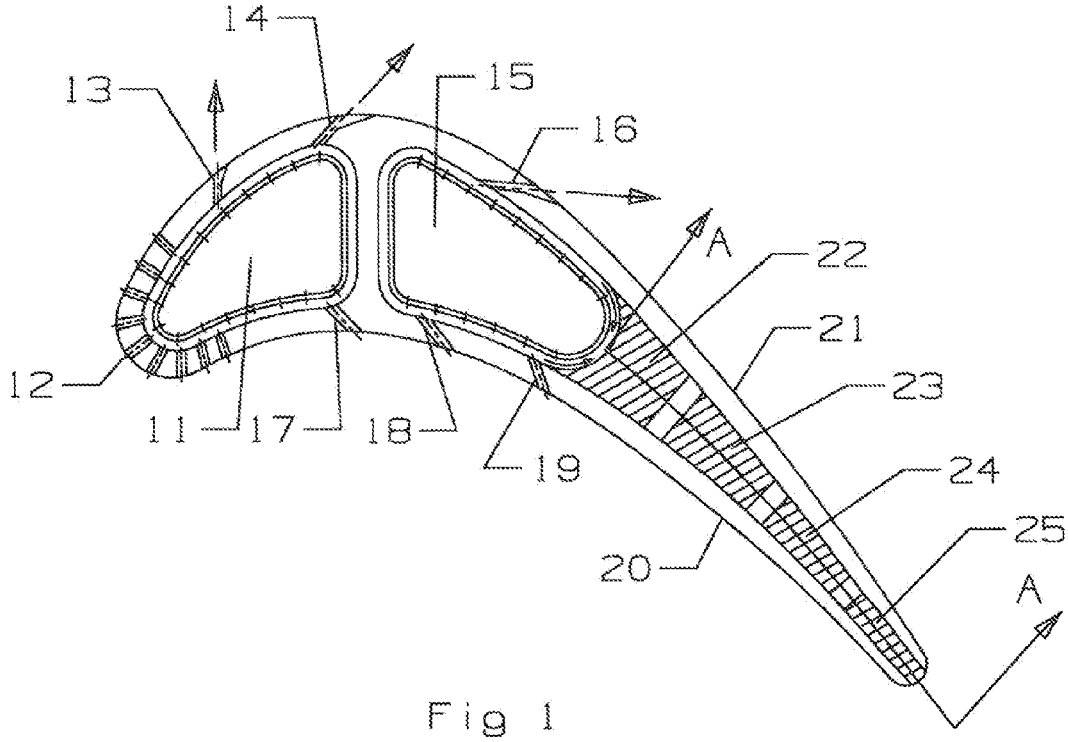
FIG. 1 shows a cut-away view through a turbine blade having the cooling channels of the present invention.

The turbine stator vane of the present invention is shown in FIG. 1 with a leading edge and a trailing edge, and a pressure side wall and a suction side wall extending between the edges and forming the airfoil portion of the blade. The invention is described for use as a turbine vane, but could also be adapted for use with a turbine rotor blade. The stator vane includes the inner and outer platform portions with an airfoil portion formed between the platforms. The vane includes one or more cooling air supply cavities that connect an external source of cooling air to the internal cooling circuit of the vane to provide for the cooling. The vane in FIG. 1 includes a leading edge cooling air supply cavity 11, an impingement plate with impingement holes formed in the plate to direct cooling air onto the inner surfaces of the vane, a showerhead arrangement of film cooling holes 12 to provide film cooling for the leading edge of the vane, a suction side gill hole or film cooling hole 13 and a pressure side gill hole or film cooling hole 17.

A second cooling air supply cavity 15 is located aft of the first or leading edge cooling supply cavity 11 and includes an impingement plate with impingement cooling holes formed within the plate to direct impingement cooling air onto the inner wall surfaces of the pressure side wall 20 and the suction side wall 21 of the vane. Pressure side film cooling holes 17, 18 and 19 and suction side film cooling holes 13, 14 and 16 discharge cooling air from the vane after the air has impinged on the inner wall surfaces.

Figure 2:
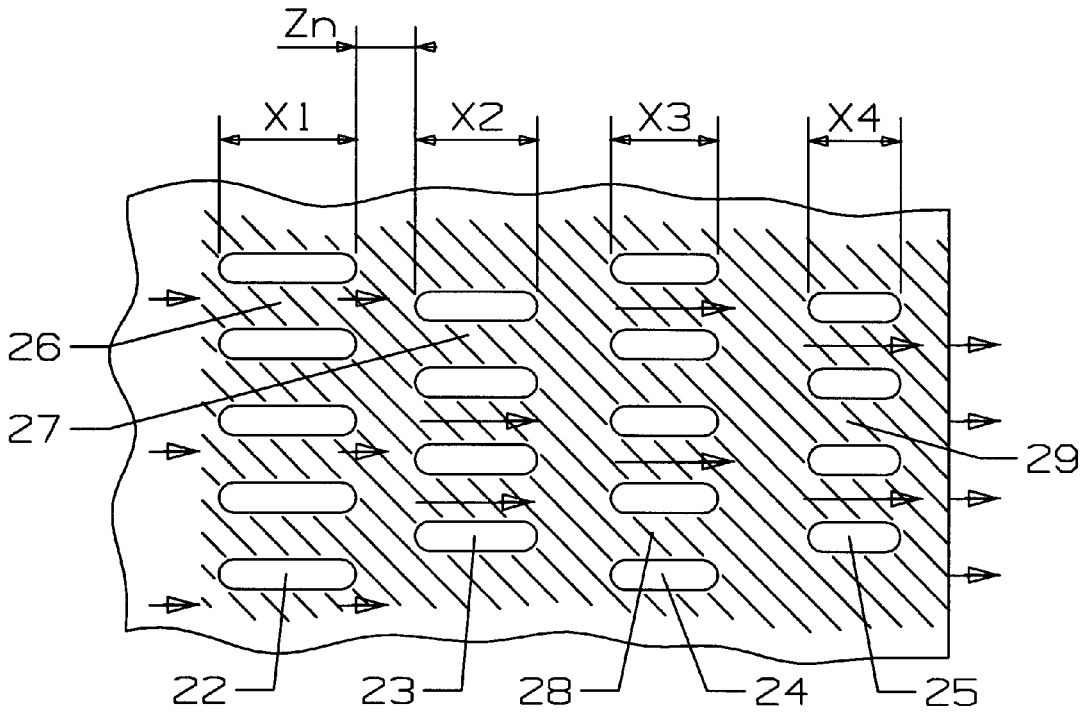
FIG. 2 shows a cross section view of the turbine blade with the mini cooling channels of the present invention.
Figure 3:
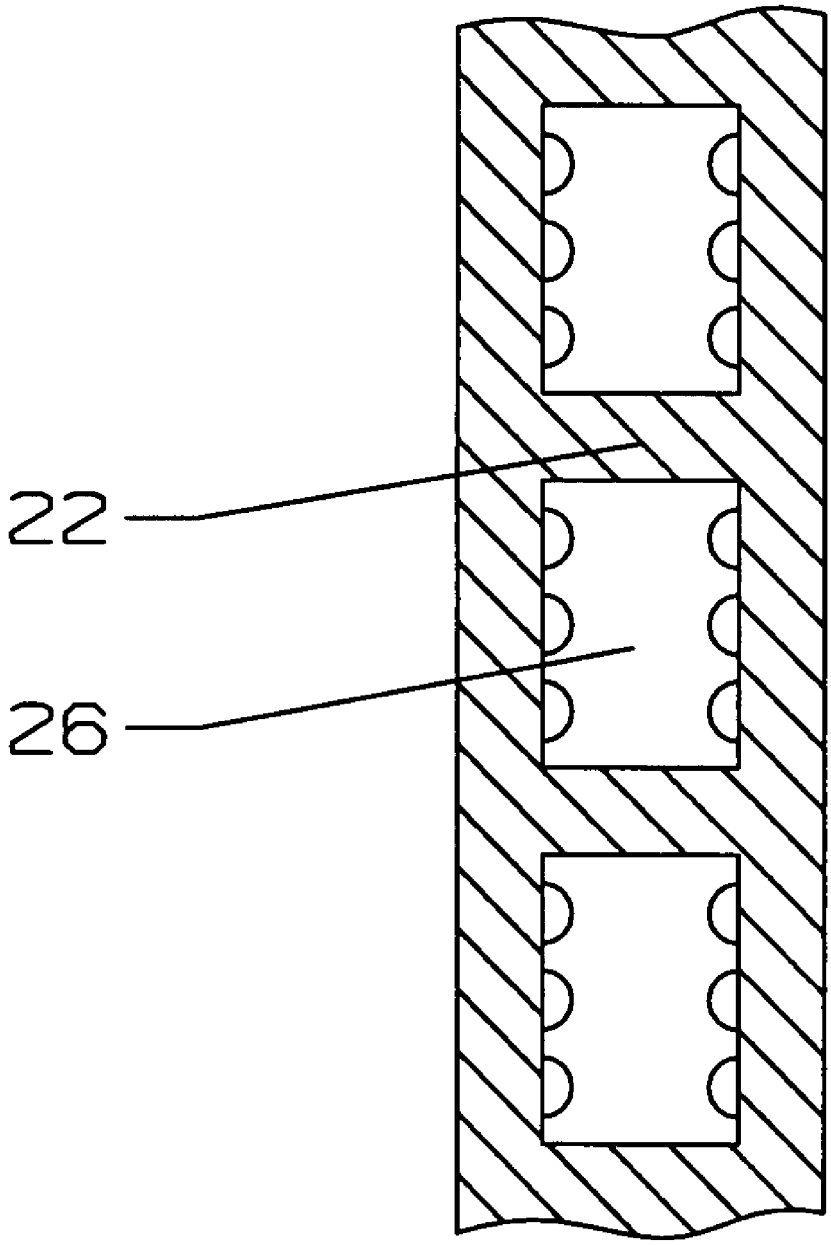
FIG. 3 is a cross section view of the trailing edge cooling passages looking along the blade chordwise length.

In the trailing edge region of the vane, located between the second cooling air supply cavity 15 and the trailing edge of the vane, is a series of mini cooling channels that extend between the pressure side and the suction side walls in the trailing edge region and provide cooling for this region. FIG. 2 shows a cross section view of the mini cooling channels formed in the trailing edge region. A series of rows of flow blockers or ribs extend between the pressure side wall 20 and the suction side wall 21 of the vane and form the mini channels.

In FIG. 2, a first row of ribs 22 extends along the spanwise direction of the vane each with a length X1 and a height such that a mini channel 26 for cooling air flow is formed between the ribs 22. The ribs 22 in the first row of a certain length X1 and form mini channels 26, and the ribs 23 in the second row have a shorter length X2 and form mini channels 27, the ribs in the third row 24 have a shorter length X3 than X2 and form mini channels 28, and the ribs in the fourth row 25 have a shorter length X4 than X3 and form mini channels 29. The ribs have about the same height in the spanwise direction but have decreasing widths due to the narrowing of the trailing edge as seen from FIG. 1. The ribs are also staggered as seen in FIG. 2 such that the cooling air exiting an upstream mini channel impinges onto the rib immediately downstream. The lengths of the ribs 22 through 25 become shorter in order to maintain a certain ratio to be described below. Cooling air flows from the second cooling air supply cavity 15 and impingement plate through the series of mini channels 26 through 29, and then exit the vane at the exits formed by the last or farthest downstream channels 29.

Each mini channel 26 through 29 forms a hydraulic diameter (Dh) which is defined as 4*Ax/P which is 4 times the cross sectional area (Ax) of the mini channel divided by the perimeter distance (P) around the mini channel. A spacing Zn between the adjacent rows of ribs is formed. The mini channels have a spacing Zn to hydraulic diameter Dh ratio of less than or equal to 4.0 ($Zn/Dh \leqq 4.0$) and a mini channel length to hydraulic diameter ratio of 5.0 or less ($x/Dh \leqq 5.0$). Also, the blockage ratio of the mini channels is about 50% compared to the main channel.

Having the mini channels within these ratios will provide for the flow through velocity of the cooling air to remain substantially constant so that the cooling effectiveness is not diminished. The unique airfoil trailing edge cooling channel construction which achieves a thin wall high efficient cooling design while maintaining the through flow velocity for the cooling passage is formed by the series of mini channels with boundary layer turbulence promoters (such as trip strips) in the cooling flow channel.

In operation, spent cooling air is supplied into the mini flow channels from the airfoil impingement cavity 15. As the coolant passes through the mini channel, it forces the cooling air to accelerate through the mini channel and generates a very high rate of heat transfer. This cooling air then exits from the mini channel before the boundary in the channel becomes fully developed. Since the spacing to hydraulic diameter ratio in-between the mini channel is less than 4.0, the cooling air exiting from the mini channel will impinge onto the downstream channel at full strength. Also, due to a 50% blockage induced by the mini channel, it creates a 2× flow area ratio in-between the main channel and the mini channels. This allows the cooling air to be fully expanded. The net effects are a creation of an extremely high turbulent cooling flow at the spacing in-between these series of mini channels, generation of high internal heat transfer coefficients, and creation of an abrupt entrance effect for the downstream mini channel. Skew trip strips can also be used in the mini channels to promote the heat transfer from the wall to the cooling air.

The major advantages of the super convective mini trailing edge cooling channel construction of the present invention over the conventional pin fin cooling channel design are described below. The mini channels increase the internal convective surface area and thus enhances the overall channel cooling effectiveness. The mini channels create more cold metal for the airfoil mid-chord section and thus lowers the airfoil sectional mass average temperature and increases the airfoil trailing edge creep capability. The mini channels break down the high aspect ratio channel into a series of smaller low aspect ratio channels and maintains the through flow velocity and internal channel heat transfer coefficient. The continuous contraction and expansion cooling concept created by the series of mini channels creates a multiple entrance phenomena. The end result of this process is to maintain a very high level of heat transfer augmentation for the entire serpentine flow channel. A thin wall cooling flow circuit for the airfoil trailing edge section is created with the design of the present invention and thus improves the overall airfoil trailing edge cooling performance.

I claim the following:

1. A turbine stator vane comprising:

a cooling air impingement cavity extending in a spanwise direction of the vane for supplying cooling air to the vane, the impingement cavity being located adjacent to a trailing edge region of the vane;

a first row of ribs formed within the trailing edge region of the vane, the first row of ribs extending between the pressure side wall and the suction side wall of the vane, the first row of ribs forming first mini cooling channels;

a second row of ribs formed within the trailing edge region of the vane, the second row of ribs extending between the pressure side wall and the suction side wall of the vane, the second row of ribs forming second mini cooling channels, the second row of ribs being staggered with respect to the first row of ribs such that cooling air discharging from the first mini channels impinges onto the leading edge of the second row of ribs; and wherein all of the ribs are elongated in an axial direction and the ribs of the first row have an axial length greater than the axial length of the ribs of the second row.

2. The turbine stator vane of claim 1, and further comprising:

a third row of ribs formed within the trailing edge region of the vane, the third row of ribs extending between the pressure side wall and the suction side wall of the vane, the third row of ribs forming third mini cooling channels; and, the third row of ribs being staggered with respect to the second row of ribs such that cooling air discharging from the second mini channels impinges onto the leading edge of the third row of ribs.

3. The turbine stator vane of claim 2, and further comprising:

the axial length of the ribs of the second row is greater than the axial length of the ribs of the third row.

4. The turbine stator vane of claim 3, and further comprising:

the rows of ribs are spaced from each other a distance Zn such that a ratio of the spacing Zn to a hydraulic diameter Dh is less than or equal to 4.

5. The turbine stator vane of claim 4, and further comprising:

a ratio of the first and the second mini cooling channels length to the hydraulic diameter is less than or equal to 5.

6. The turbine stator vane of claim 3, and further comprising:

a fourth row of ribs formed within the trailing edge region of the vane, the fourth row of ribs extending between the pressure side wall and the suction side wall of the vane, the fourth row of ribs forming fourth mini cooling channels; and, the fourth row of ribs being staggered with respect to the third row of ribs such that cooling air discharging from the third mini channels impinges onto the leading edge of the fourth row of ribs; and, the fourth cooling mini channels opening onto an exit of the vane.

7. The turbine stator vane of claim 1, and further comprising:

the leading edge of the second row of ribs is spaced from the trailing edge of the first row of ribs a distance Zn such that a ratio of the spacing Zn to a hydraulic diameter Dh is less than or equal to 4.

8. The turbine stator vane of claim 7, and further comprising:

a ratio of the first and the second mini cooling channels length to the hydraulic diameter is less than or equal to 5.

9. The turbine stator vane of claim 1, and further comprising:

a ratio of the first and the second mini cooling channels length to a hydraulic diameter is less than or equal to 5.

* * * * *